US011318476B2

(12) United States Patent
Hottenstein et al.

(10) Patent No.: US 11,318,476 B2
(45) Date of Patent: May 3, 2022

(54) SEPARATION OF FERROUS MATERIALS

(71) Applicant: MSS, Inc., Nashville, TN (US)

(72) Inventors: Felix A. Hottenstein, Nashville, TN (US); Arthur G. Doak, Nashville, TN (US); Caleb H. Blackwell, Goodlettsville, TN (US)

(73) Assignee: MSS, Inc., Nashville, TN (US)

( * ) Notice: Subject to any disclaimer, the term of this patent is extended or adjusted under 35 U.S.C. 154(b) by 89 days.

(21) Appl. No.: 16/863,354

(22) Filed: Apr. 30, 2020

(65) Prior Publication Data

US 2021/0339265 A1 Nov. 4, 2021

(51) Int. Cl.

| | |
|---|---|
| ***B03C 1/22*** | (2006.01) |
| ***B03C 1/033*** | (2006.01) |
| ***H01F 7/06*** | (2006.01) |
| ***H01F 7/20*** | (2006.01) |

(52) U.S. Cl.

CPC ..... *B03C 1/033* (2013.01); *B03C 1/22* (2013.01); *H01F 7/064* (2013.01); *H01F 7/206* (2013.01)

(58) Field of Classification Search

CPC .... B03C 1/16; B03C 1/18; B03C 1/22; B03C 1/26

USPC ..... 209/225, 226, 223.1, 217, 562, 636

See application file for complete search history.

(56) References Cited

U.S. PATENT DOCUMENTS

| | | | | |
|---|---|---|---|---|
| 765,013 | A * | 7/1904 | King | B03C 1/14 209/223.2 |
| 786,616 | A | 4/1905 | Lawrence | |
| 3,016,145 | A | 1/1962 | Spodig | |
| 3,472,375 | A | 10/1969 | Mathews | |
| 3,717,249 | A | 2/1973 | Faley et al. | |
| 3,926,792 | A | 12/1975 | Buford | |

(Continued)

FOREIGN PATENT DOCUMENTS

| | | | |
|---|---|---|---|
| EP | 155948 | A1 | 11/1991 |
| JP | 2002095995 | A | 4/2002 |

(Continued)

OTHER PUBLICATIONS

International Search Report and Written Opinion for corresponding patent application No. PCT/US2021/025703, dated Jul. 26, 2021, 11 pages (not prior art).

(Continued)

*Primary Examiner* — Patrick H Mackey

(74) *Attorney, Agent, or Firm* — Lucian Wayne Beavers; Patterson Intellectual Property Law, PC

(57) ABSTRACT

A sorting apparatus is provided for sorting selected magnetically attractable articles from non-selected magnetically attractable articles in a stream of articles. A sensor generates sensor signals representative of a property associated with a selected class of magnetically attractable articles. A separator device includes an array of magnets. A controller receives sensor signals from the sensor, identifies a location within the stream of articles of a selected magnetically attractable article, and selectively activates one or more magnets of the array of magnets and thereby magnetically attracts the selected magnetically attractable article from a first trajectory into a second trajectory while allowing non-selected magnetically attractable articles to continue along the first trajectory.

28 Claims, 9 Drawing Sheets

(56) References Cited

U.S. PATENT DOCUMENTS

| | | | | |
|---|---|---|---|---|
| 4,083,774 | A * | 4/1978 | Hunter | B03C 1/23 209/212 |
| 4,279,744 | A | 7/1981 | Antonwitsch | |
| 4,311,241 | A | 1/1982 | Lacy, Jr. et al. | |
| 4,314,645 | A | 2/1982 | Perkins et al. | |
| 4,369,873 | A | 1/1983 | Heuft | |
| 4,558,786 | A | 12/1985 | Lane | |
| 4,781,821 | A | 11/1988 | Salmi | |
| 5,057,210 | A | 10/1991 | Julius | |
| 5,092,470 | A | 3/1992 | Hakansson | |
| 5,197,607 | A | 3/1993 | Hakansson | |
| 5,509,537 | A | 4/1996 | Crismon et al. | |
| 6,056,730 | A | 5/2000 | Greter | |
| 6,062,393 | A | 5/2000 | Knoll et al. | |
| 6,068,133 | A | 5/2000 | Joachim et al. | |
| 6,634,504 | B2 | 10/2003 | Robinson et al. | |
| 6,817,474 | B2 * | 11/2004 | Ikeda | B07C 5/344 209/223.2 |
| 7,210,581 | B2 | 5/2007 | Robinson et al. | |
| 7,658,291 | B2 | 2/2010 | Valerio | |
| 8,616,362 | B1 | 12/2013 | Browne et al. | |
| 8,678,194 | B2 | 3/2014 | Rem et al. | |
| 8,807,344 | B2 | 8/2014 | Keaton et al. | |
| 8,809,718 | B1 | 8/2014 | Doak et al. | |
| 8,919,566 | B2 * | 12/2014 | Golovanevskiy | B03C 1/0335 209/223.1 |
| 9,289,778 | B2 | 3/2016 | Browne et al. | |
| 9,539,584 | B2 | 1/2017 | Oki et al. | |
| 10,137,458 | B2 * | 11/2018 | Baker | B03C 1/0332 |
| 10,350,644 | B1 | 7/2019 | Doak | |
| 2003/0127369 | A1 | 7/2003 | Robinson et al. | |
| 2007/0102325 | A1 | 5/2007 | Boffo et al. | |
| 2010/0102810 | A1 | 4/2010 | Alport et al. | |
| 2013/0186807 | A1 | 7/2013 | Browne et al. | |
| 2020/0009576 | A1 * | 1/2020 | Thakur | B03C 1/23 |

FOREIGN PATENT DOCUMENTS

| | | | |
|---|---|---|---|
| OA | 02906 | A | 12/1970 |
| WO | 2014158016 | A1 | 10/2014 |

OTHER PUBLICATIONS

Office action dated Oct. 1, 2021 in related U.S. Appl. No. 16/930,544.

* cited by examiner

SEPARATION OF FERROUS MATERIALS

BACKGROUND OF THE INVENTION

1. Field of the Invention

The present invention relates generally to systems for separating desired articles from a stream of articles. More particularly the present invention is directed to systems for recovering selected articles that include a substantial portion of magnetically attractable material.

2. Description of the Prior Art

Prior separation systems using magnetic properties have focused on separating magnetically attractable articles from non-magnetically attractable articles. Thus, the separator devices using magnets have constantly applied their magnetic attraction/repulsion forces to the entire stream of articles. These prior art systems are not suitable for separation of selected magnetically attractable articles from a stream of articles including non-selected magnetically attractable articles.

There is a need for improved separation systems capable of separation of selected magnetically attractable articles from a stream of articles including non-selected magnetically attractable articles.

SUMMARY OF THE INVENTION

In one embodiment a method of sorting a selected magnetically attractable article from non-selected magnetically attractable articles in a stream of articles may include steps of:

(a) identifying a location of the selected magnetically attractable article within the stream of articles;

(b) launching the articles along a first trajectory; and (c) selectively activating one or more magnets of an array of magnets and thereby magnetically attracting the selected magnetically attractable article from the first trajectory into a second trajectory while allowing the non-selected magnetically attractable articles to continue along the first trajectory.

In another embodiment a sorting apparatus may be provided for sorting selected magnetically attractable articles from a stream of articles including non-selected magnetically attractable articles. A sensor generates sensor signals representative of a property associated with a selected class of magnetically attractable articles. A separator device includes an array of magnets arranged for interaction with the stream of articles. A controller receives sensor signals from the sensor, identifies a location within the stream of articles of a selected magnetically attractable article, and selectively activates one or more magnets of the array of magnets and thereby magnetically attracts the selected magnetically attractable article from a first trajectory into a second trajectory while allowing non-selected magnetically attractable articles to continue along the first trajectory.

In another embodiment a sorting apparatus may include a separator device for addition to a sorting system. The separator device may include an array of electro-magnetic pole pieces each of which can be selectively activated as either a negative or a positive pole piece, and a controller. The controller may be configured to activate a first group of adjacent pole pieces including at least one negative pole piece and at least one positive pole piece thereby creating a first magnetic field extending from the first group of adjacent pole pieces toward the first trajectory.

Numerous objects, features and advantages of the present invention will be readily apparent to those skilled in the art upon reading of the following disclosure when taken in conjunction with the accompanying drawings.

BRIEF DESCRIPTION OF THE DRAWINGS

FIG. 13 shows the mechanical actuator of FIG. 11 in an extended state such that the magnetic field from the permanent magnet attracts an article passing by.

DETAILED DESCRIPTION

Figure 1:
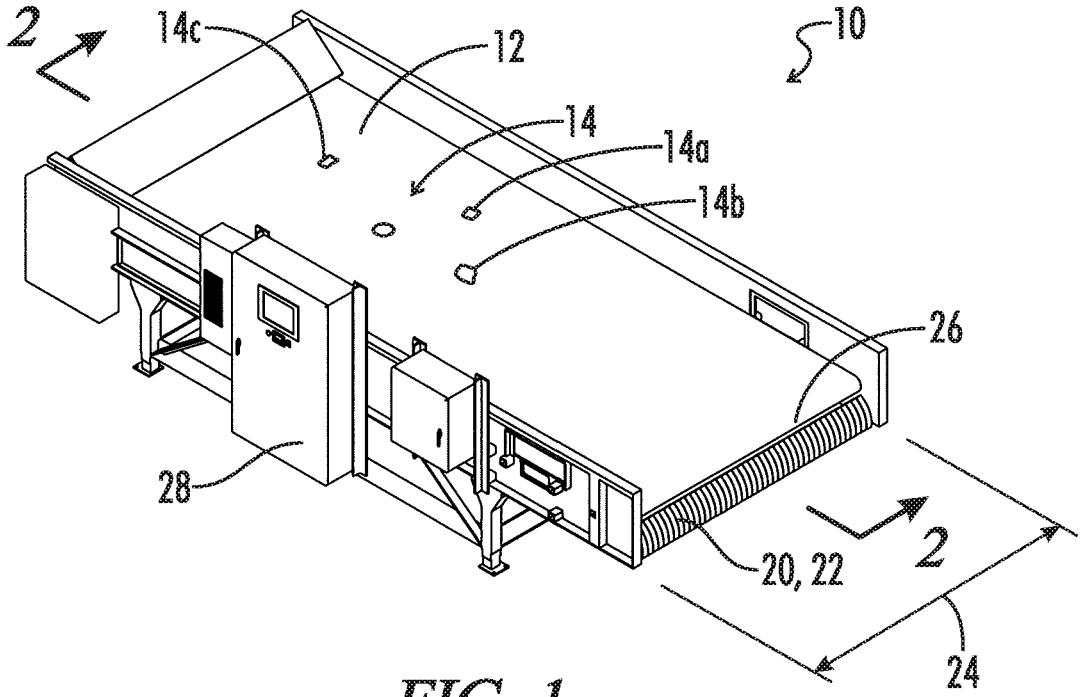
FIG. 1 is a perspective view of a sorting apparatus including a belt conveyor and a separator assembly including an array of selectively actuatable magnets.

FIG. 1 schematically illustrates a sorting apparatus 10 including a conveyor 12 for conveying a stream of articles 14 including articles 14*a*, 14*b*, 14*c*, etc.

Figure 2:
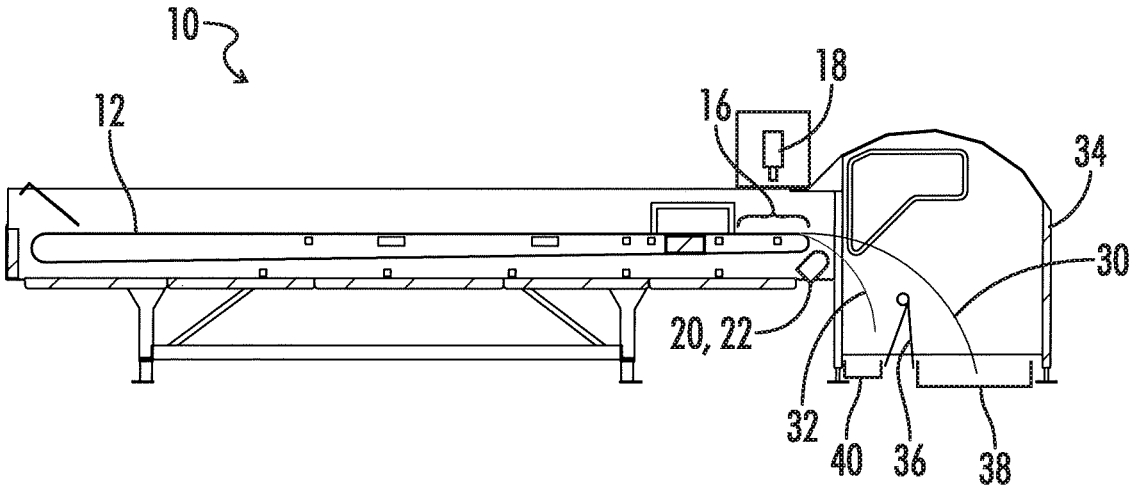
FIG. 2 is a schematic elevation view of the sorting apparatus of FIG. 1, taken along line 2-2 of FIG. 1.

As seen in FIG. 2, the conveyor 12 carries the articles through an inspection zone 16 in which a sensor 18 examines the articles to detect articles to be selected for separation from the stream of articles. The sensor 18 is configured to generate sensor signals 18S (see FIGS. 6 and 19) representative of a property associated with a selected class of magnetically attractable articles.

Figure 18:
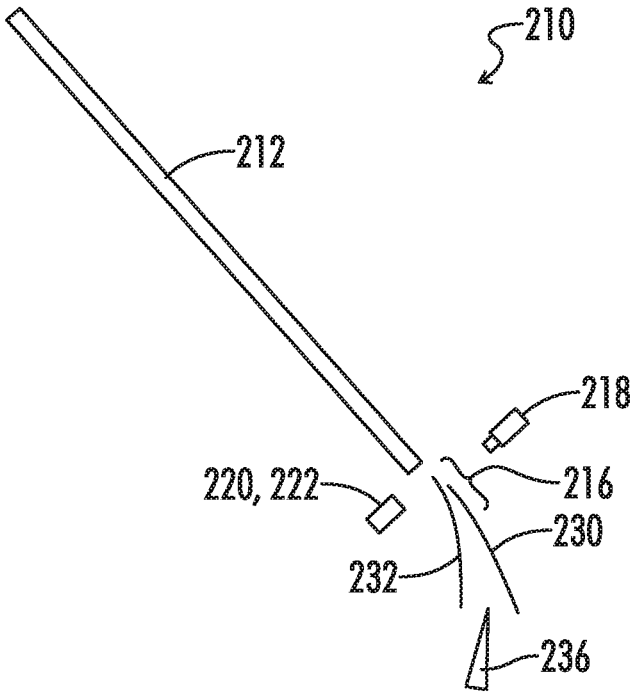
FIG. 18 is a schematic elevation view of an alternative sorting apparatus using a slide conveyor.

The conveyor 12 shown in FIGS. 1 and 2 is a belt type conveyor. As shown in FIG. 18, a slide type conveyor may also be used. Any conveyor system may be used to launch the stream of articles on a trajectory.

The stream of articles 14 may, for example, be shredded automobiles or household appliances and may include many different types of magnetically attractable articles, and of course the stream of articles may also include non-magnetically attractable articles. One group of such articles that may be selected for separation is cores of electric generators or electric motors which include substantial amounts of copper wire windings. These articles are sometimes referred to in the trade as "meatballs". Such "meatballs" may have a weight in the range of 1 lb to 20 lb or even greater. It may be desired to separate these cores from the other metal scrap so as to recover the valuable copper windings. In one example of a separation system 10 for such articles the conveyor 12 may have a width in a range of from about 36 inches to about 48 inches, and the conveyor may operate at a speed in a range of from about 100 ft/min to about 200 ft/min. The conveyor may be narrower than 36 inches or wider than 48 inches, and the operating speeds may be less than 100 ft/min or greater than 200 ft/min.

In another example, the stream of articles 14 may be shredded electronic waste. In this example again it may be desired to recover articles including copper, or other valuable metals, but the size of the articles to be separated will be smaller by orders of magnitude than the "meatballs" being separated from shredded automobiles and household appliances. The principles of separation described herein apply to each of these examples, and any others which involve a stream of articles including magnetically attractable articles that are desired to be separated from other articles including non-desirable magnetically attractable articles. The separator device for a specific process will have its magnets sized so as to provide the appropriate forces to separate the articles in question.

The sensor 18 may for example be configured to detect the red color of the copper windings. One example of such a color sensor 18 is the L-VIS optical sorter sold by MSS, Inc., the assignee of the present invention, which uses high-resolution camera technology to provide accurate color and shape separation.

Another sensor 18 may for example be the CIRRUS optical sorter sold by MSS, Inc., the assignee of the present invention, which uses a large number of near infrared and color wavelengths to scan the articles.

The sensor 18 may also identify small wire articles by shape as described in U.S. Pat. No. 8,809,718, assigned to the assignee of the present invention, the details of which are incorporated herein by reference.

The sensor 18 may also use induction-based metal detection for identifying different types of metal articles as described in U.S. Pat. No. 10,350,644, assigned to the assignee of the present invention, the details of which are incorporated herein by reference.

A separator 20 located adjacent the discharge end 26 of the conveyor 12 may include an array 22 of magnets arranged across a width 24 of the conveyor 12 and arranged for interaction with the articles passing off the discharge end 26 of the conveyor.

A controller 28 is configured to receive the sensor signals 18S from the sensor 18, to identify a location within the stream of articles of a selected magnetically attractable article, and to then selectively activate one or more magnets of the array 22 of magnets and thereby magnetically attract the selected magnetically attractable article from a first trajectory 30 into a second trajectory 32 while allowing non-selected magnetically attractable articles and non-magnetically attractable articles to continue along the first trajectory 30. Further details of the controller 28 are described below with regard to FIG. 19.

At a downstream location within a separator housing 34 a divider 36 physically divides the first and second trajectories 30 and 32. The non-selected articles following the first trajectory 30 may be collected in a first container or collection conveyor 38. The selected articles following the second trajectory 32 may be collected in a second container or collection conveyor 40.

FIG. 18 schematically illustrates a similar sorting apparatus 210 using a slide type conveyor 212. In this embodiment a sensor 218 is shown as inspecting the stream of articles in an inspection zone 216 which is located downstream of the discharge end of the slide conveyor 212. A separator 220 may include an array 222 of magnets is arranged to interact with the stream of articles and magnetically attract selected articles from the first trajectory 230 into a second trajectory 232. A divider 236 separates the articles in the first trajectory 230 from those in the second trajectory 232.

It is noted that in the embodiment of FIG. 18 the identification of the articles to be sorted occurs after the stream of articles is launched off the end of the conveyor 212, whereas in the embodiment of FIGS. 1 and 2 the identification of the articles to be sorted occurs on the conveyor 12 before the stream of articles is launched off the end of the conveyor. Either technique can be used with either type of conveyor.

Electro-Magnet Embodiment

In one embodiment the magnets of the array 22 (or the array 222) of magnets may be electro-magnets. The array 22 of electro-magnets may be constructed as an array of pole pieces 42*a*, 42*b*, 42*c*, etc., each of which can be selectively activated as either a negative or a positive pole piece.

Figure 3:
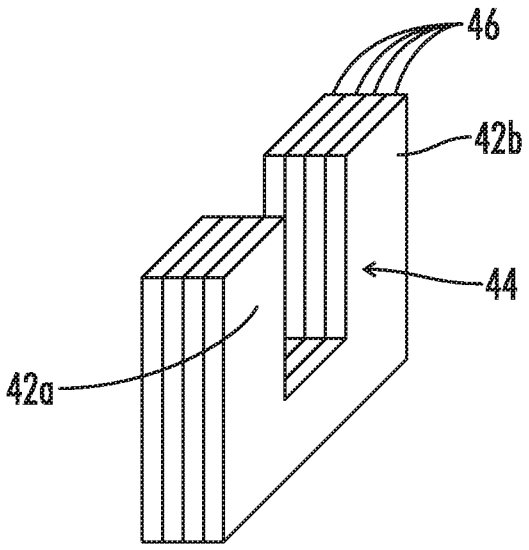
FIG. 3 is a schematic illustration of a C-core of an electro-magnet formed from laminated iron or ferrite sheets.
Figure 4:
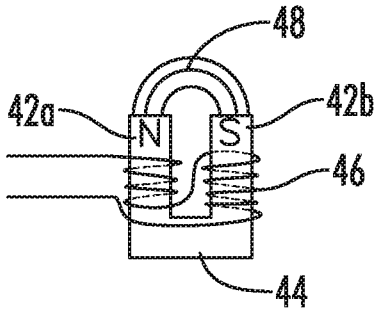
FIG. 4 is a schematic illustration of the C-core of FIG. 3 wound to form an electro-magnet.

FIG. 3 schematically illustrates a single C-shaped core 44 made up of a plurality of laminated sheets of magnetically attractable material. The material may for example be iron or ferrite or sintered magnetic material. The legs of the C-shape core 44 define two pole pieces 42*a* and 42*b*. FIG. 4 schematically illustrates the core 44 with wire windings 46 arranged such that pole piece 42*a* is a North (or negative) pole and pole piece 42*b* is a South (or positive) pole, thus creating a magnetic field 48 projecting out from the end faces of the pole pieces. The magnetic field 48 would produce an attractive force in any ferromagnetic articles passing nearby. The use of laminated sheets for the core will reduce self-heating within the pole piece by reducing eddy currents, but the core 44 can also be formed as a solid piece without laminations.

Figure 5:
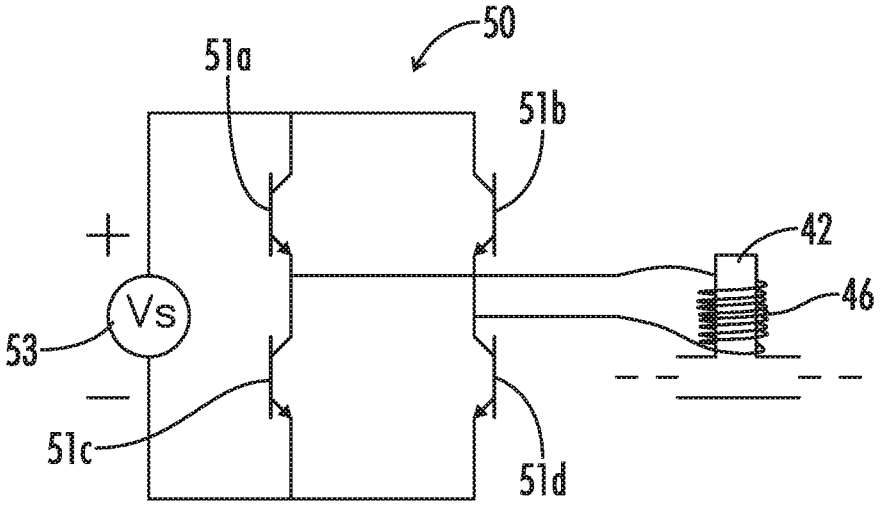
FIG. 5 is a schematic illustration of a bridge amplifier circuit for control of one of the poles of an electro-magnet.

FIG. 5 schematically illustrates a bridge amplifier circuit 50 which may be provided for each of the pole pieces 42, such that the polarity and response of each pole piece can be controlled. The bridge amplifier circuit 50 may include four switchable transistor switches 51*a*, 51*b*, 51*c* and 51*d* as shown. When switches 51*a* and 51*d* are on, the pole piece 42 is energized in one magnetic orientation (North or South)

and when switches 51*b* and 51*c* are energized the pole piece 42 is energized in the opposite magnetic orientation. This allows each pole piece to be energized in either direction using only one power supply 53.

Figure 6:
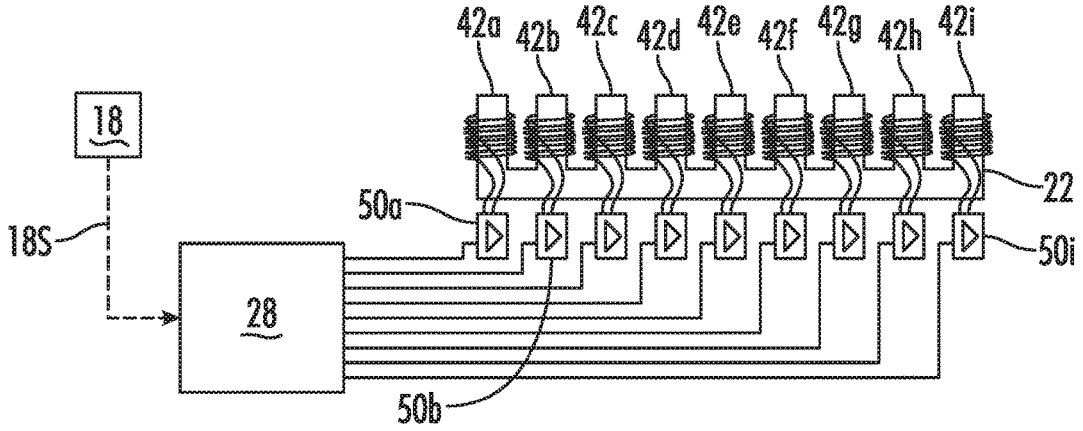
FIG. 6 is a schematic illustration of an array of pole pieces each having individual windings and an amplifier, with an associated controller.

FIG. 6 schematically illustrates the controller 28 connected to an array of such amplifiers 50*a*, 50*b*, 50*c*, etc. associated with the pole pieces 42*a*, 42*b*, 42*c*, respectively, so that the controller 28 can receive the sensor signals 18S from sensor 18 and in response thereto can selectively activate the pole pieces to create magnetic fields at the appropriate place and time, and of appropriate strengths, to attract the selected magnetically attractable articles from the stream 14 of articles.

Figure 7:
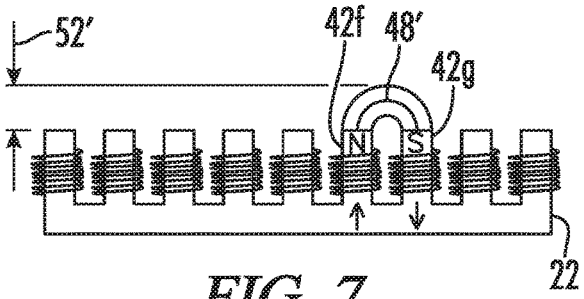
FIG. 7 is a schematic illustration of the array of pole pieces of FIG. 6 with a first group of adjacent pole pieces including one north pole and one south pole being energized.

For example, in FIG. 7 the controller has activated pole piece 42*g* as a positive pole and pole piece 42*f* as a negative pole to create electromagnetic field 48' which is schematically shown as having an influence distance 52', which can be considered to be the distance within which a magnetically attractable article of interest could be effectively attracted.

Figure 9:
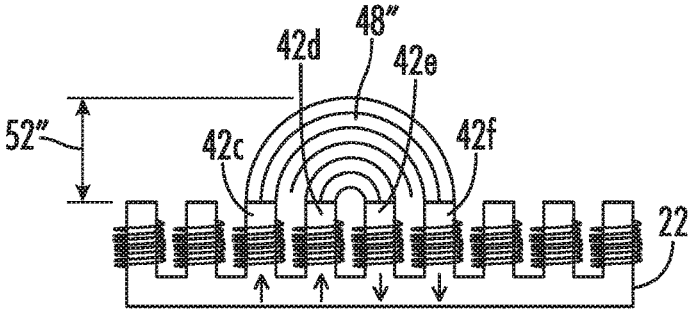
FIG. 9 is an illustration similar to FIG. 7 showing a second group of adjacent pole pieces including two north poles and two south poles being energized.

Another example, of a magnetic field 48" of greater influence distance 52" is shown in FIG. 9. In FIG. 9 the controller 28 has activated a second group of pole pieces 42*c*, 42*d*, 42*e* and 42*f* such that pole pieces 42*e* and 42*f* are positive and pole pieces 42*c* and 42*d* are negative, thus forming a larger electro-magnet than was formed in FIG. 7, having a larger influence distance 52".

Figure 8:
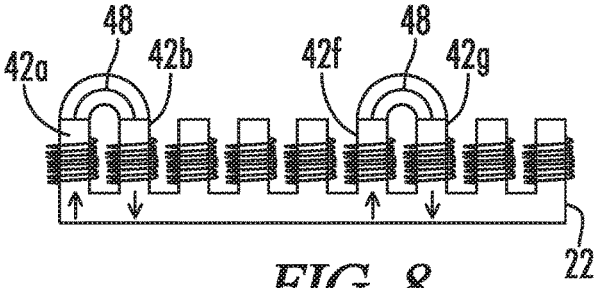
FIG. 8 is an illustration similar to FIG. 7 showing a second group of adjacent pole pieces including one north pole and one south pole being energized.

FIG. 8 shows a further example in which two separate electro-magnets have been formed by activation of pole pieces 42*a* and 42*b* to form the first electro-magnet and activation of pole pieces 42*f* and 42*g* to form the second electro-magnet.

Figure 10:
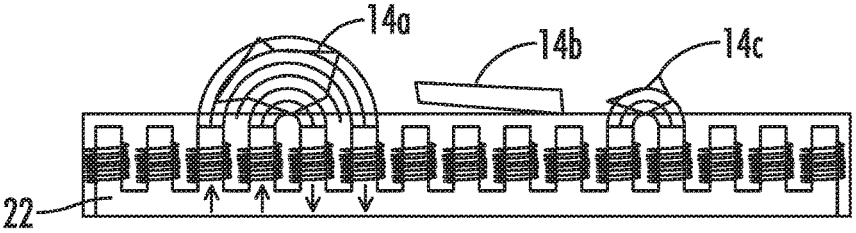
FIG. 10 is an illustration similar to FIG. 7 showing a smaller magnetically attractable article being acted on by one group of pole pieces, a larger magnetically attractable article being acted on by another group of pole pieces, and showing a third article passing over the array of pole pieces without interaction.

FIG. 10 schematically illustrates an expanded array 22 of pole pieces and three articles 14*a*, 14*b* and 14*c* passing off the end 26 of the conveyor 12 over the array 22. In this case articles 14*a* and 14*c* have been selected for separation along the second trajectory 32, while article 14*b* is being allowed to pass across the array without deflection thus passing along the first trajectory 30. The article 14*a* has been determined to be a larger article and a group of four pole pieces has been activated to attract the article 14*a* to the second trajectory 32. The article 14*c* has been determined to be a smaller article and a group of two pole pieces has been activated to attract the article 14*c* to the second trajectory 32.

Figure 16:
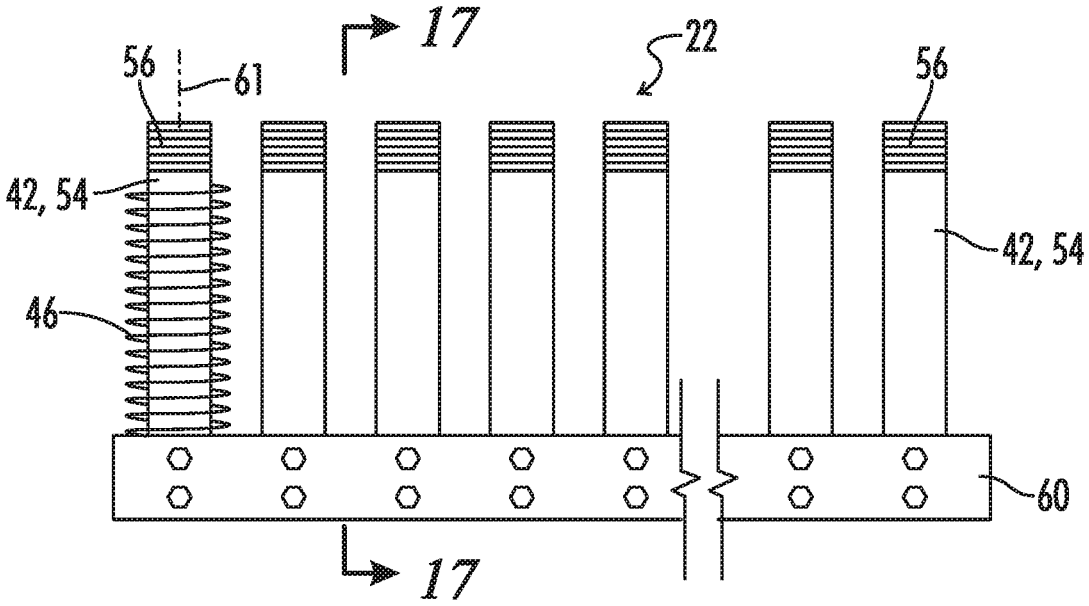
FIG. 16 is a plan view of one embodiment of the array of electro-magnets.
Figure 17:
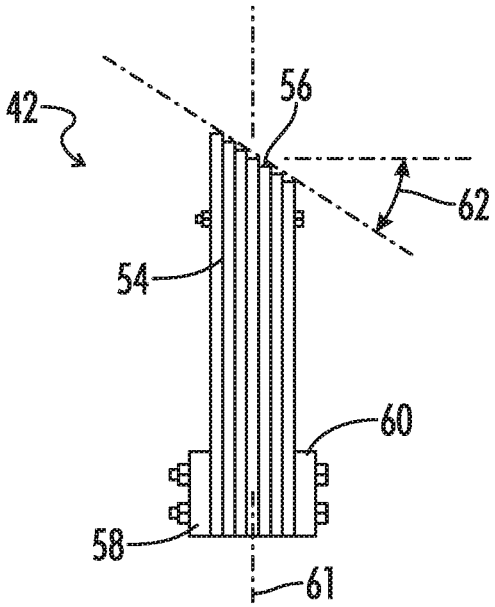
FIG. 17 is a section view of the array of electro-magnets of FIG. 16 taken along line 17-17.

FIGS. 16 and 17 show one example of how the array 22 of pole pieces may be constructed for use in sorting relatively large articles such as those from shredded automobiles or household appliances. Each of the pole pieces 42 may be formed of a two inch high stack of one inch wide metal strips 54 approximately eight inches long. Each pole piece 42 has a longitudinal axis 61 (see FIG. 14) parallel to its length. The longitudinal axis 61 may be oriented approximately normal to the second trajectory 32 where the axis 61 intersects the trajectory 32. The outer ends of the strips may be staggered so as to define an end face 56 approximately one inch by two inches and generally sloped at a shallow angle 62 (see FIGS. 14 and 17) in the downstream direction. The angle 62 is measured from a line perpendicular to the longitudinal axis 61 of the pole piece. The stacks of metal strips have their base ends clamped between two base bars 58 and 60. There may be a one inch spacing between adjacent pole pieces, so that the magnetic field 48 from two adjacent pole pieces may affect an area over a width of about three inches.

Figure 14:
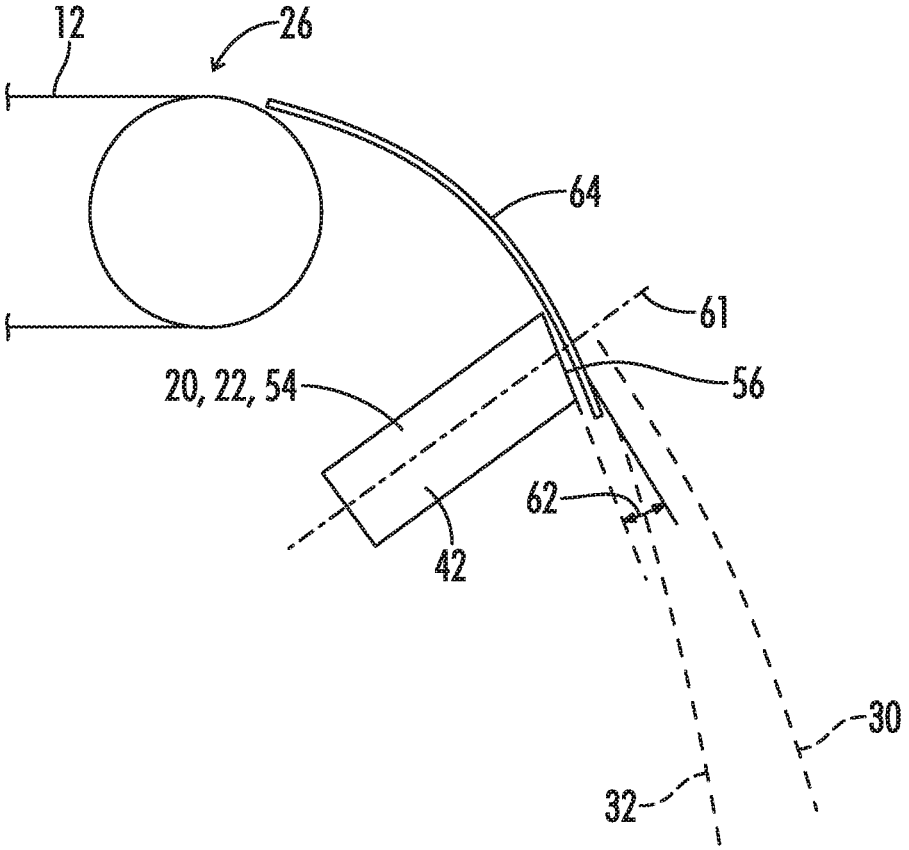
FIG. 14 is a schematic side elevation view of one embodiment of the array of electro-magnets adjacent the discharge end of the conveyor with a cover sheet shielding the electro-magnets from impact by the articles leaving the conveyor.

FIG. 14 schematically illustrates the array 22 of FIGS. 16 and 17 in place adjacent the end 26 of conveyor 12. A non-magnetic cover sheet 64 may be placed over the array 22 of magnets to prevent impact of the articles 14 with the pole pieces of array 22. Cover sheet 64 may for example be a thin sheet of stainless steel arranged to underlie and parallel the expected path of the second trajectory 32. The cover sheet 64 may for example be constructed of 304 stainless steel of 16 gauge (0.063 inch thick). Alternatively the cover sheet 64 may be formed of plastic, ceramic, carbon fiber, Kevlar, or any suitable non-magnetic material capable of withstanding the wear of impact with the articles being separated. It will be appreciated that there will be some variance in the second trajectory 32 for different articles. The actual trajectory 32 for a given article will be a function of the speed of the article when it leaves the conveyor belt 12, the mass of the article, and the attractive force applied by the array 22 of magnets.

Also in order to maximize the effectiveness of the array 22 of magnets in attracting the selected articles 14 it is desirable to have the end face 56 of the pole pieces as close as possible to the articles 14, preferably no greater than ¼ inch away, more preferably no greater than $\frac{1}{8}^{th}$ inch away, and even more preferably no more than $\frac{1}{16}^{th}$ inch away. This can be accomplished, while still protecting the pole pieces 42 from impact by the articles 14, by using the cover sheet 64 and placing the end faces 56 of the pole pieces against the underside of the cover sheet 64. Preferably the end face 56 of each pole piece across the entire end face 56 is located no more than ¼ inch, and more preferably no more than $\frac{1}{8}^{th}$ inch, and still more preferably no more than $\frac{1}{16}^{th}$ inch from the underside of the cover sheet 64.

Figure 15:
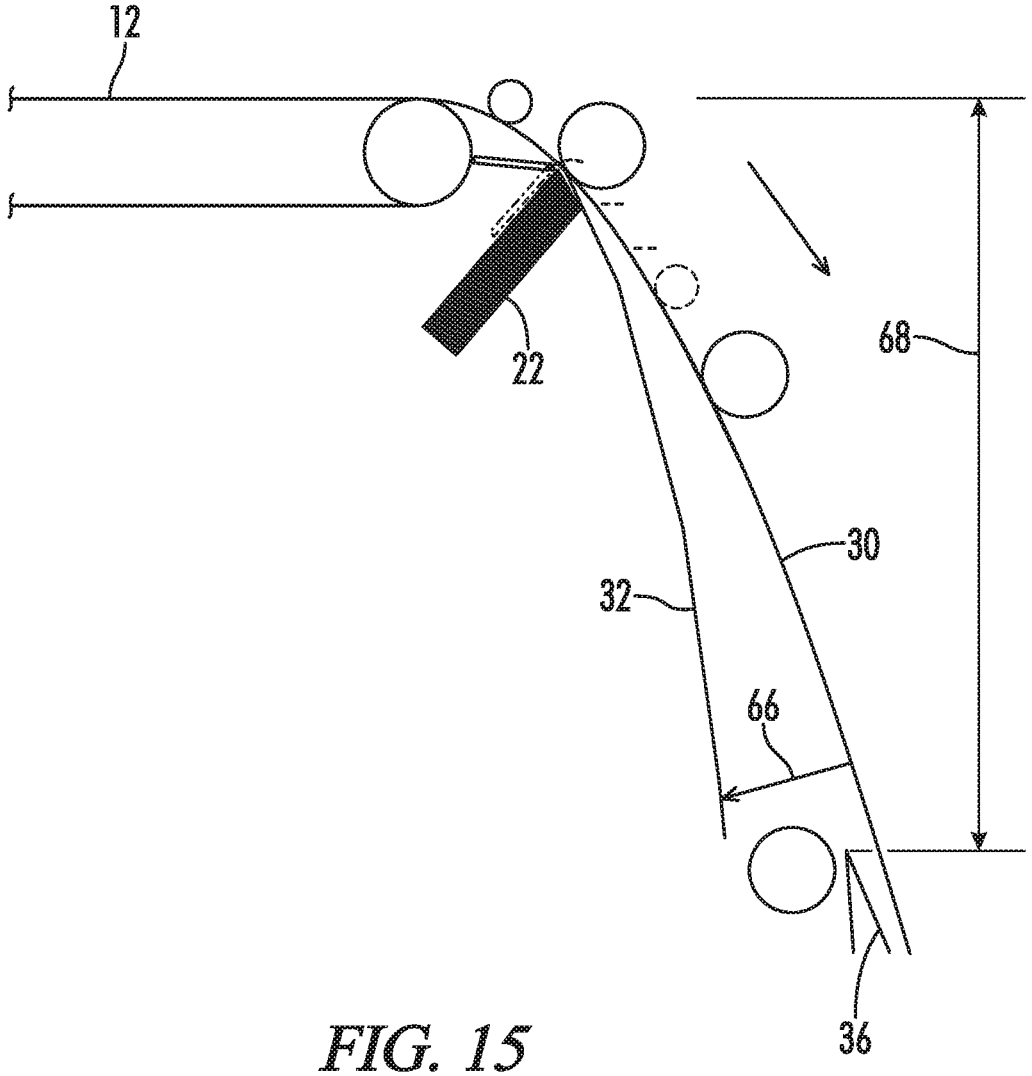
FIG. 15 is a schematic side elevation view of the array of electro-magnets like that of FIG. 14, and illustrating the distances involved in the separation of the articles.

FIG. 15 schematically illustrates some of the parameters which must be taken into consideration when designing such a system. The end goal is to create a sufficient displacement 66 between the two trajectories 30 and 32 at the location of the divider 36 so that the selected articles will be reliably separated from the non-selected articles. This displacement 66 is a function of the attractive force applied to the selected articles by the array 22 of magnets, and the drop distance 68 between the conveyor 12 and the divider 36. In one example for a drop distance 68 of 36 inches and for a displacement 66 of six inches it has been calculated that the attractive force to be applied to the selected articles by the array 22 of magnets should be about twice the weight of the article in order to achieve the desired six inch displacement.

Figure 11:
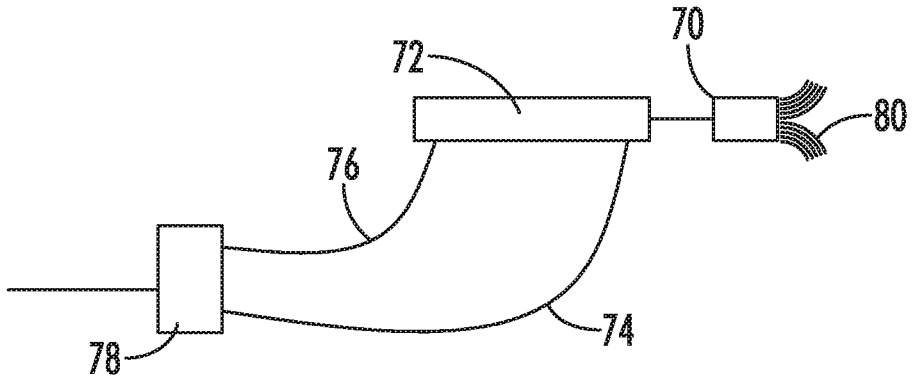
FIG. 11 is a schematic illustration of a mechanical actuator carrying a permanent magnet.
Figure 12:
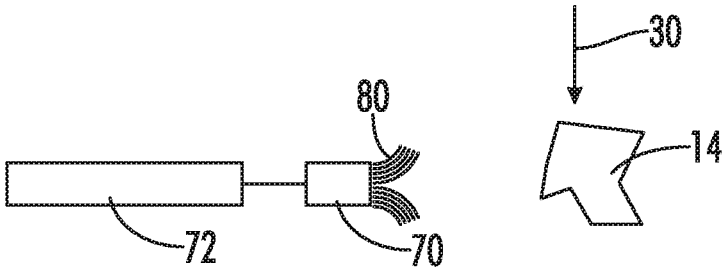
FIG. 12 shows the mechanical actuator of FIG. 11 in a retracted state allowing an article to pass by without interaction.
Figure 13:
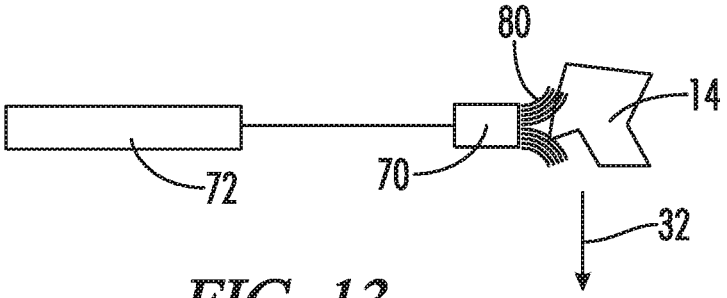

Permanent Magnet Embodiment of FIGS. 11-13

FIGS. 11-13 illustrate a second embodiment in which the magnets of the array 22 of magnets are permanent magnets 70 each of which is mounted on a movable actuator 72 to physically move the permanent magnets 70 relative to the first trajectory. As schematically illustrated in FIG. 11 each movable actuator 72 may for example be a hydraulic or pneumatic cylinder receiving fluid power via fluid power supply/return lines 74 and 76 from a fluid supply control valve 78 that is operated in response to a control signal from the controller 28.

FIG. 12 illustrates the permanent magnet 70 being held in a retracted position relatively far away from an article 14 moving along the first trajectory 30, so the trajectory of the article 14 is not affected. When an article 14 is selected for separation from the stream of articles, the movable actuator 72 is extended as schematically shown in FIG. 13 so that a magnetic field 80 of the permanent magnet 70 interacts with the article 14, so as to pull the article 14 away from the first trajectory 30 to the second trajectory 32.

In a further embodiment the movable actuators 72 may be used to move electro-magnets which are switched on and off as described above for the electromagnet embodiment. This combines the magnetic attraction effect of both closer physical proximity and an activated electromagnet.

Figure 19:
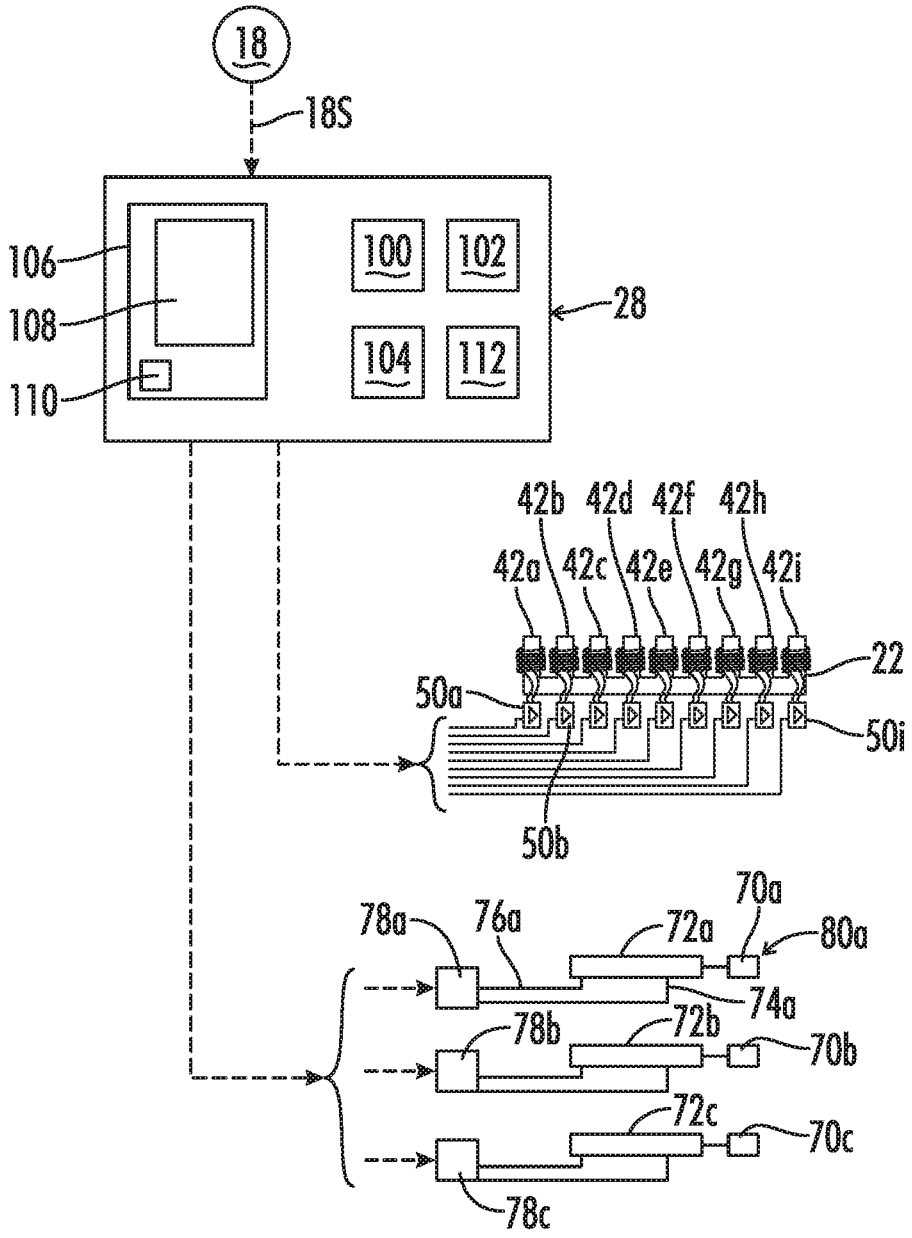
FIG. 19 is a schematic illustration of the controller connected to a sensor and to the actuators for the arrays of magnets.

The Controller:

Details of the controller 28 are further shown schematically in FIG. 19. The controller 28 may configured to receive the sensor signals 18S from the sensor 18, and to generate control signals to actuate the magnets of the array 22 (or of the array 222).

The controller 28 may also receive other signals indicative of various functions of the sorting apparatus 10. The signals transmitted from the various sensors to the controller 28 are schematically indicated in FIG. 19 by phantom lines connecting the sensors to the controller with an arrowhead indicating the flow of the signal from the sensor to the controller.

Similarly, the controller 28 will generate command signals for controlling the operation of the various actuators, which command signals are indicated schematically in FIG. 19 by phantom lines connecting the controller to the various actuators with the arrow indicating the flow of the command signal from the controller 28 to the respective actuator. In the electro-magnetic embodiment the command signals may be electrical signals sent to the amplifiers 50*a*, 50*b*, etc. In the permanent magnet embodiment the command signals may be electrical signals sent to the control valves such as 78*a*, 78*b*, 78*c*, etc. for the individual actuators such as 72*a*, 72*b*, 72*c* of the magnets such as 70*a*, 70*b*, 70*c*, etc. of the array of permanent magnets.

Controller 28 includes or may be associated with a processor 100, a computer readable medium 102, a data base 104 and an input/output module or control panel 106 having a display 108. An input/output device 110, such as a keyboard or other user interface, is provided so that the human operator may input instructions to the controller. It is understood that the controller 28 described herein may be a single controller having all of the described functionality, or it may include multiple controllers wherein the described functionality is distributed among the multiple controllers.

Various operations, steps or algorithms as described in connection with the controller 28 can be embodied directly in hardware, in a computer program product 112 such as a software module executed by the processor 100, or in a combination of the two. The computer program product 112 can reside in RAM memory, flash memory, ROM memory, EPROM memory, EEPROM memory, registers, hard disk, a removable disk, or any other form of computer-readable medium 102 known in the art. An exemplary computer-readable medium 102 can be coupled to the processor 100 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

Methods of Operation

One method of sorting selected magnetically attractable articles from non-selected magnetically attractable articles in a stream 14 of articles may include:

(a) identifying a location of the selected magnetically attractable article within the stream of articles;

(b) launching the articles along the first trajectory 30 (or 230); and (c) selectively activating one or more magnets of the array 22 of magnets and thereby magnetically attracting the selected magnetically attractable article from the first trajectory 30 into a second trajectory 32 (or 232) while allowing the non-selected magnetically attractable articles to continue along the first trajectory 30.

In an embodiment such as illustrated in FIG. 2 step (a) is performed before step (b). In an embodiment such as illustrated in FIG. 18 step (a) is performed after step (b).

It is noted that the term "trajectory" is used in the broad sense to mean a path of the articles in free fall under the control of gravity. Although the trajectories are shown as curved, a trajectory could also be directed straight down.

In one embodiment of this method in step (c) the magnets may be electro-magnets and the selectively activating may include electrically energizing the one or more electro-magnets.

As schematically shown in FIG. 7 the array 22 of electro-magnets may include an array of pole pieces 42*a*, 42*b*, etc. each of which can be selectively activated as either a negative or a positive pole piece, and in step (c) a first group of adjacent pole pieces 42*f*, 42*g* may be activated including at least one negative pole piece 42*f* and at least one positive pole piece 42*g* thereby creating a first magnetic field 48' extending from the group of adjacent pole pieces toward the first trajectory 30.

As schematically shown in FIG. 9 step (c) may further include activating a second group of adjacent pole pieces 42*c*, 42*d*, 42*e*, 42*f* including at least two negative pole pieces 42*c*, 42*d*, and at least two positive pole pieces, 42*e*, 42*f*, thereby creating a second magnetic field 48" extending from the second group of adjacent pole pieces toward the first trajectory 30, the second magnetic field 48" being larger than the first magnetic field 48'.

In another embodiment, as schematically illustrated in FIGS. 11-13, the magnets may be permanent magnets 70 and the step of selectively activating may include physically moving the one or more permanent magnets 70 closer to the first trajectory 30. This may be accomplished by extension of the movable actuators 72.

The method may further include shielding the magnets with a non-magnetic cover sheet 64 covering the array 22 of magnets to prevent impact of the articles 14 with the magnets.

Thus, it is seen that the apparatus and methods of the present invention readily achieve the ends and advantages mentioned as well as those inherent therein. While certain preferred embodiments of the present invention have been illustrated and described for purposes of the present disclosure, numerous changes in the arrangement and construction of parts and steps may be made by those skilled in the art which changes are encompassed within the scope and spirit of the present invention as defined by the appended claims

What is claimed is:

1. A method of sorting a selected magnetically attractable ferromagnetic article from other articles including non-selected magnetically attractable ferromagnetic articles in a stream of articles, comprising:

(a) identifying a location of the selected magnetically attractable ferromagnetic article within the stream of articles;

(b) launching the stream of articles along a first trajectory; and (c) selectively activating one or more magnets of an array of magnets and thereby magnetically attracting the selected magnetically attractable ferromagnetic article toward the array of magnets from the first trajectory into a second trajectory while allowing the non-selected magnetically attractable ferromagnetic articles to continue along the first trajectory.

2. The method of claim 1, wherein step (b) occurs after step (a).

3. The method of claim 1, wherein step (b) occurs before step (a).

4. The method of claim 1, wherein:

step (a) further comprises identifying the location of the selected magnetically attractable ferromagnetic article within the stream of articles on a conveyor; and step (b) further comprises launching the stream of articles off the conveyor along the first trajectory.

5. The method of claim 4, wherein in step (a) the conveyor is a belt conveyor.

6. The method of claim 4, wherein in step (a) the conveyor is a slide conveyor.

7. The method of claim 1, wherein:

in step (c) the magnets are electro-magnets and the selectively activating includes electrically energizing the one or more electro-magnets.

8. The method of claim 7, wherein:

the array of electro-magnets includes an array of pole pieces each of which can be selectively activated as either a negative or a positive pole piece; and in step (c) a first group of adjacent pole pieces are activated including at least one negative pole piece and at least one positive pole piece thereby creating a first magnetic field extending from the group of adjacent pole pieces toward the first trajectory.

9. The method of claim 8, wherein:

in step (c) a second group of adjacent pole pieces are activated including at least two negative pole pieces and at least two positive pole pieces thereby creating a second magnetic field extending from the second group of adjacent pole pieces toward the first trajectory, the second magnetic field being larger than the first magnetic field.

10. The method of claim 7, wherein:

the array of electro-magnets includes an array of pole pieces each of which can be selectively activated as either a negative or a positive pole piece; and in step (c) a group of adjacent pole pieces are activated including at least two negative pole pieces and at least two positive pole pieces thereby creating a magnetic field extending from the group of adjacent pole pieces toward the first trajectory.

11. The method of claim 1, wherein:

in step (c) the magnets are permanent magnets and the selectively activating includes physically moving the one or more permanent magnets closer to the first trajectory.

12. The method of claim 1, further comprising:

shielding the magnets with a non-magnetic cover sheet covering the array of magnets to prevent impact of the articles with the magnets.

13. A sorting apparatus for sorting a selected class of magnetically attractable ferromagnetic articles from a stream of articles, comprising:

a sensor configured to generate sensor signals representative of a property associated with the selected class of magnetically attractable ferromagnetic articles;

an array of magnets arranged for interaction with the stream of articles; and a controller configured to:

receive the sensor signals;

identify a location within the stream of articles of a selected magnetically attractable ferromagnetic article; and selectively activate one or more magnets of the array of magnets and thereby magnetically attract the selected magnetically attractable ferromagnetic article toward the array of magnets from a first trajectory into a second trajectory while allowing non-selected magnetically attractable ferromagnetic articles to continue along the first trajectory.

14. The apparatus of claim 13, further comprising:

a conveyor for conveying the stream of articles through an inspection zone, the conveyor including a discharge end, the conveyor having a width;

the sensor is arranged to generate the sensor signals as the stream of articles passes through the inspection zone; and wherein the array of magnets is arranged across the width of the conveyor for interaction with the stream articles as the stream of articles passes off the discharge end of the conveyor.

15. The apparatus of claim 14, wherein:

the conveyor is a belt conveyor.

16. The apparatus of claim 14, wherein:

the conveyor is a slide conveyor.

17. The apparatus of claim 13, wherein:

the magnets are electro-magnets; and the controller is configured to selectively activate the one or more electro-magnets by electrically energizing the one or more electro-magnets.

18. The apparatus of claim 17, wherein:

the array of electro-magnets includes an array of pole pieces each of which can be selectively activated as either a negative or a positive pole piece; and the controller is configured to selectively activate the one or more electro-magnets by activating a group of adjacent pole pieces including at least one negative pole piece and at least one positive pole piece thereby creating a magnetic field extending from the group of adjacent pole pieces toward the first trajectory.

19. The apparatus of claim 13, wherein:

the magnets are permanent magnets; and the controller is configured to selectively activate the one or more permanent magnets by physically moving the one or more permanent magnets closer to the first trajectory.

20. The apparatus of claim 13, further comprising:

a plurality of movable actuators, each magnet being mounted on one of the movable actuators so that the magnet is movable between at least a first position and a second position by movement of its respective actuator.

21. The apparatus of claim 20, wherein:

the controller is configured to selectively activate the one or more magnets by actuating one or more of the movable actuators associated with the one or more magnets to physically move the one or more magnets closer to the first trajectory.

22. The apparatus of claim 21, wherein the magnets are permanent magnets.

23. The apparatus of claim 21, wherein the magnets are electro-magnets.

24. The apparatus of claim 13, further comprising:

a non-magnetic cover sheet covering the array of magnets to prevent impact of the articles with the magnets.

25. The apparatus of claim 24, wherein:

the array of magnets includes an array of pole pieces, each pole piece having an end face located no more than 0.25 inch from the cover sheet.

26. The apparatus of claim 13, wherein:

the array of magnets includes an array of pole pieces, each pole piece having a longitudinal axis, and each pole piece having an end face closest to the articles, the end face being sloped relative to the longitudinal axis in a downstream direction of the articles.

27. The apparatus of claim 13, further comprising:

a conveyor for conveying the stream of articles, the conveyor including a discharge end; and the sensor is arranged to inspect the stream of articles while the stream of articles is on the conveyor.

28. The apparatus of claim 13, further comprising:

a conveyor for conveying the stream of articles, the conveyor including a discharge end; and the sensor is arranged to inspect the stream of articles after the stream of articles is launched off the discharge end of the conveyor.

* * * * *